US010815757B2

(12) United States Patent
Osaland et al.

(10) Patent No.: US 10,815,757 B2
(45) Date of Patent: Oct. 27, 2020

(54) SYSTEM AND METHOD FOR CLEANING A RECEPTACLE

(71) Applicant: Altus Intervention (Technologies) AS, Stavanger (NO)

(72) Inventors: Espen Osaland, Sandnes (NO); Daniel Skretting, Sandnes (NO)

(73) Assignee: Altus Intervention (Technologies) AS, Stavanger (NO)

( * ) Notice: Subject to any disclaimer, the term of this patent is extended or adjusted under 35 U.S.C. 154(b) by 51 days.

(21) Appl. No.: 16/078,134

(22) PCT Filed: Mar. 14, 2017

(86) PCT No.: PCT/NO2017/050063
§ 371 (c)(1),
(2) Date: Aug. 21, 2018

(87) PCT Pub. No.: WO2017/160157
PCT Pub. Date: Sep. 21, 2017

(65) Prior Publication Data

US 2019/0203568 A1 Jul. 4, 2019

(30) Foreign Application Priority Data

Mar. 15, 2016 (NO) ..... 20160433

(51) Int. Cl.
*E21B 41/00* (2006.01)
*B08B 9/032* (2006.01)
(Continued)

(52) U.S. Cl.
CPC ..... *E21B 41/00* (2013.01); *B08B 9/032* (2013.01); *B08B 9/093* (2013.01); *E21B 27/04* (2013.01); *E21B 37/02* (2013.01); *B08B 2209/08* (2013.01)

(58) Field of Classification Search
None
See application file for complete search history.

(56) References Cited

U.S. PATENT DOCUMENTS 4,157,096 A 6/1979 Miller, Jr.
4,600,444 A 7/1986 Miner
(Continued)

FOREIGN PATENT DOCUMENTS

NO 20150340 A1 9/2016
SE 448831 * 3/1987 ..... B08B 9/02
(Continued)

OTHER PUBLICATIONS

Machine translation of SE 448831.*

*Primary Examiner* — Levon J Shahinian
*Assistant Examiner* — Jason P Riggleman
(74) *Attorney, Agent, or Firm* — Gable Gotwals

(57) ABSTRACT

A receptacle is formed with a bottom end and a top end and houses an auger conveyor. The system includes at least one bottom sub comprising an inlet end and an outlet end. The outlet end is releasably connectable to a receptacle bottom end. At least one top assembly, comprising a house with an entrance releasably connectable to the receptacle top end and an outlet for connection to an outlet line, and a chamber within the house. The chamber forms a flow path between the entrance and the outlet. A retention tank is connected to the at least one top assembly outlet by the outlet line. A pump is connected to the retention tank on a pump suction side by a supply line, and the pump on the pressure side being connected to the at least one bottom sub by an inlet line.

6 Claims, 3 Drawing Sheets

(51) Int. Cl.

| | |
|---|---|
| ***E21B 27/04*** | (2006.01) |
| ***E21B 37/02*** | (2006.01) |
| ***B08B 9/093*** | (2006.01) |

(56) References Cited

U.S. PATENT DOCUMENTS

| | | | | |
|---|---|---|---|---|
| 5,299,639 | A * | 4/1994 | Williams | E21B 27/04 166/311 |
| 5,372,154 | A | 12/1994 | Bee et al. | |
| 5,857,476 | A | 1/1999 | Bee et al. | |
| 2007/0007365 | A1 * | 1/2007 | Kitamura | B05B 3/02 239/237 |
| 2013/0220389 | A1 | 8/2013 | Snow | |
| 2014/0332031 | A1 * | 11/2014 | Leggett | B08B 9/0322 134/8 |

FOREIGN PATENT DOCUMENTS

| | | | |
|---|---|---|---|
| SE | 448831 | B | 3/1987 |
| WO | 03036020 | A1 | 5/2003 |

* cited by examiner

SYSTEM AND METHOD FOR CLEANING A RECEPTACLE

CROSS-REFERENCE TO RELATED APPLICATIONS

This United States application is the National Phase of PCT Application No. PCT/NO2017/050063 filed 14 Mar. 2017, which claims priority to Norwegian Patent Application No. 20160433 filed 15 Mar. 2016, each of which is incorporated herein by reference.

BACKGROUND OF THE INVENTION

This invention relates to an apparatus and a method for cleaning a receptacle. In particular the invention concerns cleaning a receptacle that has been filled with debris from a well in the ground, especially a petroleum well. More particularly the receptacle is filled with debris and the receptacle comprises a conveyor auger vanes.

It happens relatively often that particulate materials in the form of silt, sand, loosened deposits, drill-fluid particles, cuttings and other material settle on the inside of a pipe belonging to a well in the ground. The well may be a well producing oil or a well producing a gas. Such particulate materials may, if they build up to a sufficient degree, be highly obstructive to a fluid flow through the pipe. The deposited material is normally removed by means of a collecting tool. It is known to use various types of collecting tools in connection with coiled-tubing operations, snubbing or drilling operations.

Even in smaller amounts, particulate materials may be a problem even if they do not affect the well production to any significant degree. The particulate materials may, for example, be a hindrance to maintenance works, especially when it is a question of simple methods such as cable works. It is not unusual for deposited sand and other material in a well, even in moderate amounts, to prevent tools from reaching the desired position in the well during maintenance works.

According to the prior art, in conventional wells, a debris collector is used, which is lowered into the well by means of a cable, for example. The debris collector includes at least one collecting chamber. Debris collectors exist that operate in different ways. A collector of a first type may be hammered into the particulate material, and a collector of another type may suck into the particulate material by means of an integrated piston arrangement or by a plate opening to a room at atmospheric pressure, whereby the well pressure displaces the particulate material into the collecting chamber.

Most prior-art methods are simple and relatively inexpensive to implement. They are thus well suited for conventional wells in which the particulate material forms bridges covering the entire pipe cross section, and in which it is therefore easy to fill the collecting chambers with particulate materials by means of one of the above-mentioned methods.

Patent document WO 03/036020 discloses a collecting device which is provided with a conveyor screw in which the leading portion of the conveyor screw is provided with a scraper or another suitable tool. The conveyor screw, which is driven by a motor, is arranged to move loosened particulate materials into a collecting container.

Collecting devices for removing particulate materials in a well include elongated, tubular collecting containers. Together with other necessary equipment such as a tool for loosening the particulate material, a motor for driving the tool and a device for displacing the collecting device, such as a wireline tractor, the collecting device and equipment typically form an equipment string of 15 metres. This equipment string is sluiced into the well in a known manner through a lubricator above the wellhead. The lubricator may have a capacity for sluicing in known well tools which are typically up to 30 metres long. Typical known collecting devices have a capacity for removing 20-30 litres of particulate material on every trip into the well. An alternative to using collecting devices as described is to provide a coiled tubing with a suitable well cleaning arrangement. It is considerably more complex to mobilize equipment for a coiled-tubing wash out operation than for an operation using wireline-operated equipment. It will therefore be a considerable saving if wireline-operated equipment can be used as an alternative to coiled tubing to remove particulate material in the well.

Collecting devices as disclosed must be arranged in such a way that the material collected will not flow out of the collecting container when the collecting device is being brought up to the lubricator of the well. Especially in the vertical portion of the well, collected material may flow out of the collecting container. Such flow-out can be prevented by the collecting device being provided with a check valve in its lower portion. The check valve may be a flap valve.

When the collecting device is filled, it is brought to the surface and into the lubricator, and from the lubricator to be laid down on deck. A clean and empty collecting device is immediately positioned in the lubricator and lowered into the well in a known manner to continue collecting particulate material in the well. The operation is carried out as fast as possible to reduce the down time of the well.

The collecting device which contain the collected debris is stripped down into the leading portion, an intermediate section and a top section on the drilling deck. The leading section may include a scraper, a conveyor and a valve. The intermediate section comprises a receptacle which comprises at least one collecting container. The collecting container has a bottom end and a top end. The receptacle houses an auger conveyor, and the auger conveyor is supported with bearings. The receptacle may comprise several collecting containers joined together such that the top end of a first collecting container is connected to the bottom end of the next collecting container. Each collecting container comprises an auger conveyor, and the auger conveyors are connected such that they rotate together. The top section comprises a filter section and a fluid outlet and a through shaft which connects the auger conveyor with a rotational motor above the top section when the collecting device is assembled in a complete tool string. The tool string may comprise a tractor system.

After stripping down the collecting device, the receptacle is cleaned for collected debris. The debris may be compact and hard and difficult to get out of the receptacle. The bearings and the auger conveyor make the interior uneven and cleaning is difficult and time consuming. Cleaning is performed by a combination of scraping material out of the receptacle and scouring with low pressure water and high pressure water. When some of the material is removed or at least softened, more material is displaced out of the receptacle by turning the auger conveyor. The material contains water, mud, solids and oil. The material may in some cases even be of low radioactivity. Handling of the material is not regulated as the volume is relative small. The material is first led freely down to the deck and thereafter collected. Fluid is flushed down a suitable drain. As a result the deck in the work area becomes wet, dirty and slippery. The work environment in this area becomes unsatisfactory, unpleasant and even dangerous.

The receptacle should be empty and clean, and the collecting device assembled and ready, before the other collecting device return from its trip in the well as described above. By experience, the cleaning operation takes a long time, and the operation halts while waiting for commissioning of the collecting device.

The invention has for its object to remedy or to reduce at least one of the drawbacks of the prior art, or at least provide a useful alternative to prior art.

One object of the present invention is to make it possible to clean a receptacle filled with debris from a well in shorter time than known by current methods. A further object is to make the work environment cleaner and more safe, and reduce the exposure of hazardous substances to the workers. A further object is to collect the debris and make it possible to dispose the debris in a controlled and safe manner.

The objects are achieved through features, which are specified in the description below and in the claims that follow.

The invention is defined by the independent patent claims. The dependent claims define advantageous embodiments of the invention.

In a first aspect the invention relates more particularly to a system for cleaning at least one receptacle, said receptacle is formed with a bottom end and a top end, and said receptacle is housing an auger conveyor, where the system comprises:

- at least one bottom sub comprising an inlet end and an outlet end, said outlet end is releasly connectable to the receptacle's bottom end;
- at least one top assembly, comprising a house with an entrance releasly connectable to the receptacle's top end and an outlet for connection to an outlet line, a chamber within the house, said chamber forming a flow path between the entrance and the outlet;
- a retention tank connected to the at least one top assembly's outlet by the outlet line; and
- a pump connected to the retention tank on the pump's suction side by a supply line, and said pump on the pump's pressure side being connected to the at least one bottom sub by an inlet line.

The house may comprise a wrench shaft with a leading end at the entrance, and a drive end at the opposite end, said drive end is located outside the house, and said leading end is connectable to a top end of the auger conveyor. The drive end may be connectable to a wrench.

The house may comprise an auxiliary port leading to the chamber, a three-way valve may be connected to the inlet line, and a by-pass line may connect the three-way valve with the auxiliary port.

The pump may be an air driven pump supplied with pressurized air from an air supply line.

Two or more receptacles are connected to the pump's pressure side by the inlet line and to the tank by the outlet line.

One receptacle may comprise two or more collecting containers. The collecting containers may be connected in series, i.e. a top end of a first collecting container is connected to a bottom end of a next collecting container.

In a second aspect the invention relates more particularly to a method of cleaning a receptacle, said receptacle is formed with a bottom end and a top end, and said receptacle is housing an auger conveyor, and the method comprises the step of:

- provide a system as described previously;
- provide the at least one receptacle containing a material;
- connect the at least one bottom sub to the at least one receptacle's bottom end;
- connect the at least one top assembly to the at least one receptacle's top end;
- start the pump;
- pass cleaning fluid from the retention tank through the pump, the at least one bottom sub, the at least one receptacle, the at least one top assembly and back to the retention tank; and
- collect the washed out material in the retention tank.

The method may further comprise:

- provide at least one top assembly with a wrench shaft;
- connect the wrench shaft's leading end to the auger conveyor and the wrench shaft's drive end to a wrench;
- start the wrench; and
- flush out displaced material from the chamber with the cleaning fluid from the at least one bottom sub.

The method may as an alternative further comprise:

- provide at least one top assembly with a wrench shaft and an auxiliary port leading to the chamber;
- connect the wrench shaft's leading end to the auger conveyor and the wrench shaft's drive end to a wrench;
- connect a three-way valve to the inlet line, and connect a by-pass-line from the three-way valve to the auxiliary port;
- start the wrench;
- operate the three-way valve to flow cleaning fluid to the auxiliary port; and
- flush out displaced material from the chamber with the cleaning fluid from the auxiliary port.

In the following is described examples of preferred embodiments illustrated in the accompanying drawings, wherein.

Figure 1:
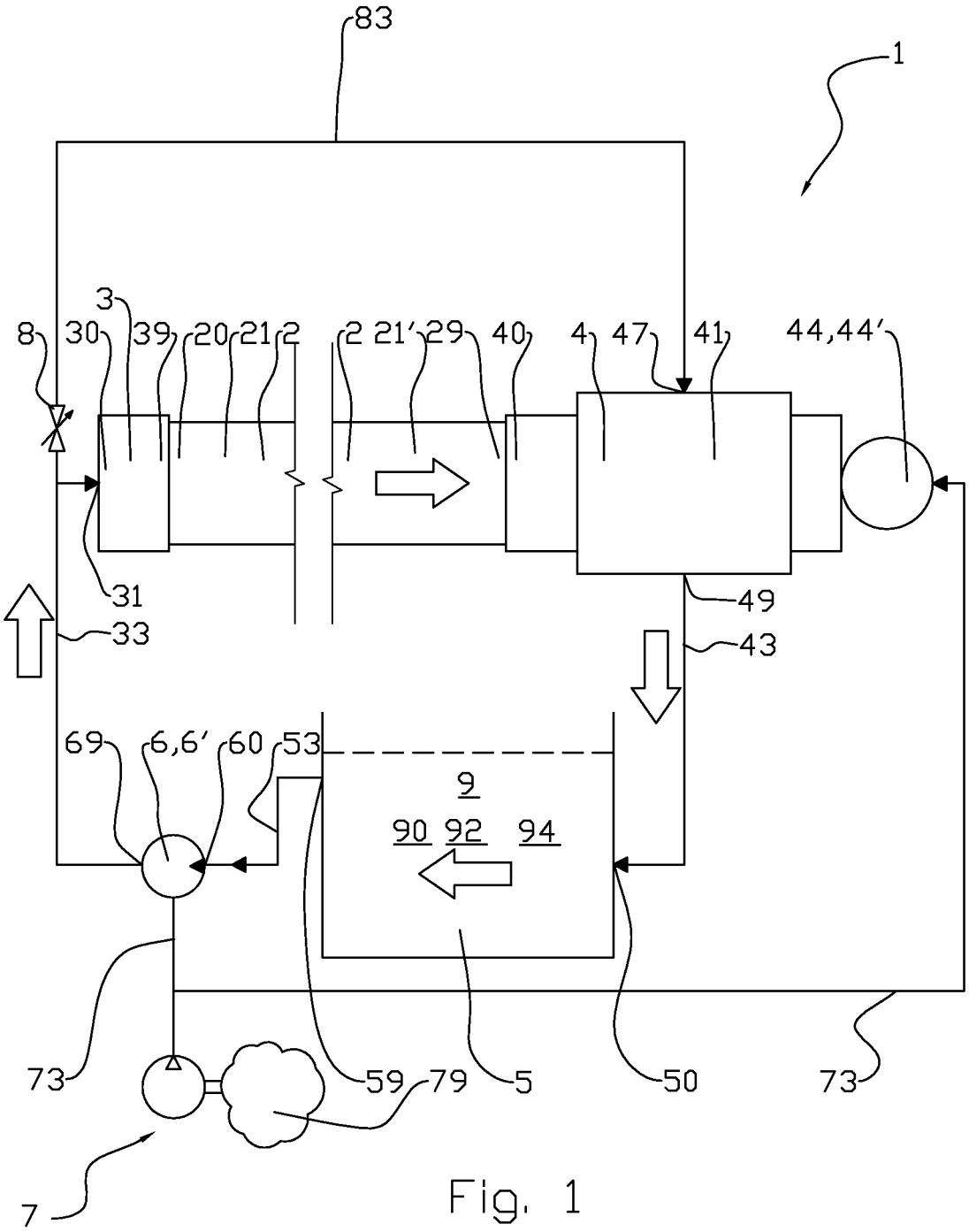
FIG. 1 shows a schematic diagram of the components according to the invention.
Figure 2:
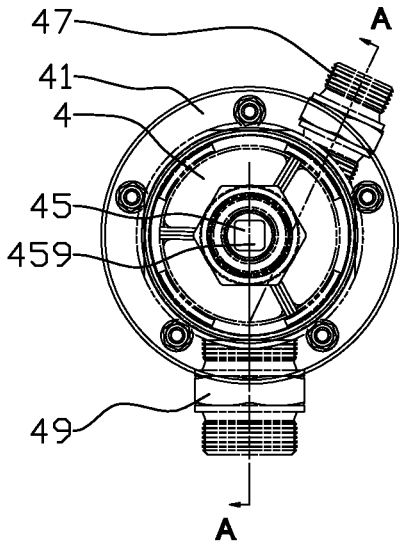
FIG. 2 shows an end view of the top sub.

In the drawings, the reference numeral 1 indicates a system for washing a receptacle 2 of a collecting device (not shown). The collecting device is used to clean out debris (not shown) from a well bore (not shown). The system 1 comprises a bottom sub 3, a top assembly 4, a retention tank 5, a pump 6 and several fluid lines for connecting the components. The system 1 may optionally comprise an air supply 7.

The receptacle 2 to be cleaned is stripped from the collecting device. The receptacle 2 forms an extended tube which comprises one or several collecting containers 21, 21'. Each collecting container 21, 21' has a bottom end and a top end. The top end of a first collecting container 21 is connected to the bottom end of the next collecting container 21'. The receptacle 2 has a threaded bottom end 20 and a threaded top end 29. Each collecting container 21, 21' may house an auger conveyor 22.

The bottom sub 3 forms an inlet end 30 and an outlet end 39. The outlet end 39 comprises internal thread 301 and can be thready connected to external threads 201 of the bottom end 20 of the receptacle 2. The inlet end 30 is provided with a threaded connection 31 for connection to an inlet line 33.

The top assembly 4 comprises a house 41. The house 41 is provided with external threads 401 at an entrance 40 which can be threadly connected to internal threads 291 at the top end 20 of the receptacle 2. At the interior the house 41 is provided with a chamber 42. The house 41 is further provided with a threaded outlet 49 for connection to an outlet 43. The chamber 42 forms a fluid path between the entrance 40 and the outlet 49.

Figure 3:
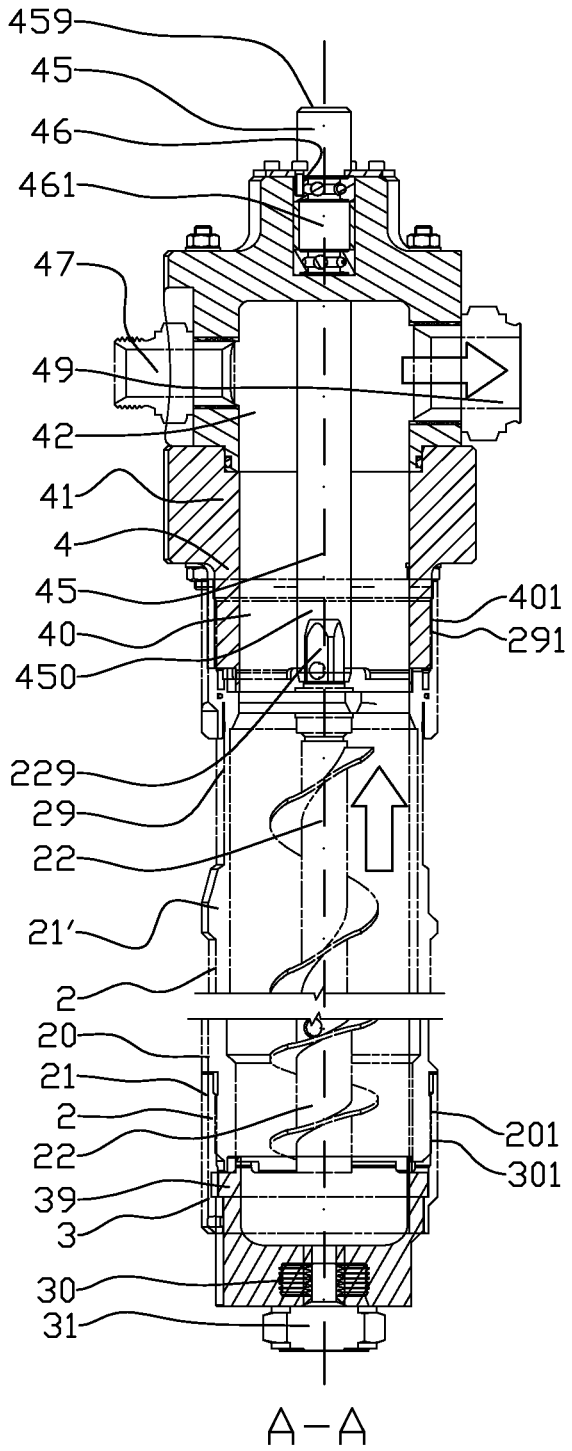
FIG. 3 shows a transverse section of a receptacle, a top sub and a bottom sub according to the invention.

Optionally the top assembly 4 comprises a wrench 44. The wrench 44 may be an air-driven wrench 44'. The wrench 44, 44' is positioned on the house 41 opposite of the entrance 40 (see FIG. 1). A shaft 45 runs from the wrench 44, through a hole 46 in the house 41, through the chamber 42 and the shaft 45 is at a leading end 450 connected to the top end 229 of the auger conveyor 22 when the top assembly 4 is connected to the receptacle 2 as shown in FIG. 3. A bearing 461 is positioned within the hole 46. The shaft 45 is at an opposite drive end 459 provided with suitable connections for a wrench 44, 44'.

The house 41 is further optionally provided with an auxiliary threaded port 47 which leads into the chamber 42.

The retention tank 5 is provided with an inlet 50 and an outlet 59. The retention tank 5 may be open, but is preferably closed. The retention tank 5 is operated at ambient pressure. The outlet line 43 is connected to the inlet 50. A supply line 53 connects the outlet 59 to an inlet 60 on the suction side of the pump 6. The pump 6 may be an air driven pump 6, for example an air driven membrane pump 6'. The inlet line 33 connects the outlet 69 on the pressure side of the pump 6, 6' with the inlet 30. Thereby there is formed a continuous flow path through the receptacle 2, house 41, outlet line 43, retention tank 5, supply line 53, pump 6, inlet line 33 and bottom sub 3.

Optionally a three-way valve 8 is connected to the inlet line 33. A by-pass line 83 connects the three-way valve 8 with the auxiliary port 47. The three-way valve 8 may be a ball valve.

The optionally air supply 7 comprises an air supply line 73. The air supply line 73 is connected to a source 79 of pressurized air. The air supply 7 provides pressurized air to the air driven pump 6' and to the optional air driven wrench 44'.

It may be advantageous that the retention tank 5 is filled with a cleaning fluid 9, for example fresh water 90, or a soap solution 92, or diesel oil 94 or other suitable solvent or cleaning agent prior to use of the system 1.

The collecting device is lifted out of the lubricator and positioned on deck (not shown). The collecting device is stripped. The bottom sub 3 is threadly fixed to the bottom end of the receptacle 2 and the top assembly 4 is threadly fixed to the top end of the receptacle 2.

In case the collected debris is loose and soft, the pump 6, 6' is started and cleaning fluid 9 is pumped from the retention tank 5 through the receptacle 2, through the chamber 42 and back to the retention tank 5 where the washed out material mix with the cleaning fluid. As the system 1 forms a closed loop, there is no risk of overflow and spillage. All washed out material is collected in the retention tank 5 and the workers are not exposed to debris and chemicals. There is no dirt and spillage on the deck and in the work area.

If necessary the auger conveyor 22 is turned by a wrench 44. The wrench may be any kind of suitable wrench 44, for example an air driven wrench 44'. Turning the auger conveyor 22 assists in moving material out of the receptacle 4 towards the chamber 42. Too much material in the chamber 42 or too dry material may block the chamber 42. The three-way valve 8 is then operated and cleaning fluid 9 flows to the auxiliary port 47 through the by-pass line 83 and into the chamber 42. The wrench 44 may be stopped until the material is flushed out of the chamber 42. The three-way valve may be regulated such that a portion of the cleaning fluid 9 flows into the receptacle 2 at the bottom sub 3 and the remaining portion of cleaning fluid 9 flows into the chamber 42.

In case the collected debris is hard and compact, the pump 6, 6' is started and the entire cleaning fluid 9 flows initially into the chamber 42. This will soften and wash out the debris at the top end 29 of the receptacle 2. By combining wash out from the top with turning the auger conveyor 22 by the wrench 44, more debris will be displaced towards the chamber 42. Cleaning fluid 9 is in addition filled into the available space at the bottom end 20 of the receptacle 2 and will soften and loosen the debris from that end.

By operating the wrench 44 and the tree-way valve 8 in combination, the receptacle 2 is cleaned from even hard and compact debris much faster than by conventional technique.

Figure 4:
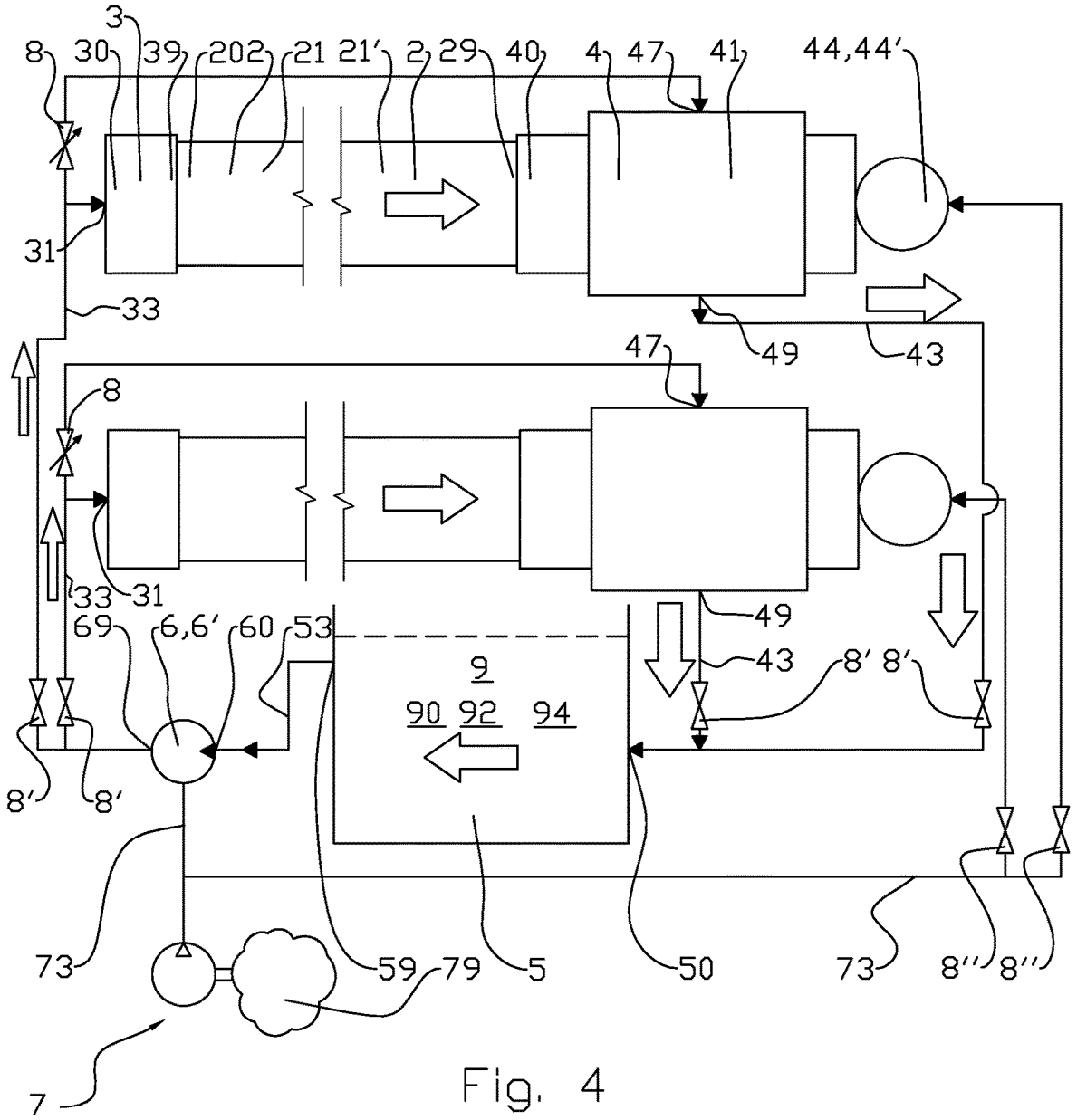
FIG. 4 shows the same as FIG. 1, but in an alternative embodiment with two receptacles.

FIG. 4 shows an alternative embodiment of the invention. Two receptacles 2 are connected to the pump 6, 6' via an inlet line 33. The receptacles 2 are connected to the tank 5 via the outlet line 43. Each receptacle 2 is provided with a bottom sub 3 and a top sub 4 as described above. The top sub 4 may be of any of the alternatives with a wrench 44 and an auxiliary port 47 as described above. The inlet line 33 and the outlet line 43 may be provided with additional valves 8' for selectively closure of the inlet line 33 and outlet line 43 from the different receptacles 2. The valve 8' may be a ball valve. The air supply line 73 may be provided with additional valves 8" for selectively closure to the optional air driven wench 44'. The skilled person will know that the system 1 in this way may be modified to comprise more than two receptacles 2.

Washed out material is collected in the retention tank 5 and may be transported onshore for further proper treatment.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. System for cleaning at least one receptacle, said receptacle forms an extended tube and is formed with a threaded bottom end and a threaded top end, and said receptacle is housing an auger conveyor, characterised in that the system comprises:

at least one bottom sub comprising an inlet end and an outlet end, said outlet end is releasably and threadly connectable to the bottom end of the at least one receptacle so that an opening of the outlet end is mouthing into the at least one receptacle;

at least one top assembly comprising a house with an entrance releasably connectable to the threaded top end of the at least one receptacle and an outlet for connection to an outlet line, a chamber within the house, said chamber forming a flow path between the entrance and the outlet;

a retention tank connected to the at least one top assembly outlet by the outlet line; and a pump connected to the retention tank on a suction side by a supply line, and said pump on a pressure side being, connected to the at least one bottom sub by an inlet line; and a continuous flow path through the receptacle, house, outlet line, retention tank, supply line, pump and bottom sub; and wherein the house comprises an auxiliary port leading to the chamber, a three-way valve is connected to the inlet line, and a by-pass line connects the three-way valve with the auxiliary port.

2. System according to claim 1, wherein the house comprises a wrench shaft with a leading end at the entrance, and a drive end at the opposite end, said drive end is located outside the house, and said leading end is connectable to a top end of the auger conveyor.

3. System according to claim 2, wherein the drive end is connectable to a wrench.

4. System according to claim 1 where the pump is an air driven pump supplied with pressurized air from an air supply line.

5. System according to claim 1 where two or more receptacles are connected to the pump pressure side by the inlet line and to the tank by the outlet line.

6. System according to claim 1 where one receptacle comprises two or more collecting containers.

* * * * *